United States Patent [19]

Berkowitz

[11] 3,952,542

[45] Apr. 27, 1976

[54] VENTILATOR

[75] Inventor: Irving L. Berkowitz, Binghamton, N.Y.

[73] Assignee: Kason Hardware Corporation, Binghamton, N.Y.

[22] Filed: Nov. 22, 1974

[21] Appl. No.: 526,265

[52] U.S. Cl. ..... 62/409; 98/87; 98/119; 62/408; 137/493.8

[51] Int. Cl.[2] ..... F25D 17/04

[58] Field of Search ..... 98/87, 119; 62/408, 62/409; 137/493.8

[56] References Cited

UNITED STATES PATENTS

| | | | |
|---|---|---|---|
| 2,132,879 | 10/1938 | Pownall | 62/307 |
| 2,139,991 | 12/1938 | Wingard | 98/119 |
| 2,527,782 | 10/1950 | Williams | 62/314 |
| 2,820,475 | 1/1958 | Hobbs | 98/87 |
| 3,004,401 | 10/1961 | Mann | 62/419 |
| 3,359,755 | 12/1967 | Creech | 62/441 |
| 3,813,896 | 6/1974 | Lebalm | 62/409 |

*Primary Examiner*—William J. Wye
*Attorney, Agent, or Firm*—Paul J. Sutton

[57] ABSTRACT

The present invention includes a ventilator for use in equalizing pressures within and without an enclosure, such as a coldroom or the like. A heated valve assembly is situated within an enclosure wall opening such that it is freely exposed to both environmental and internal fluid air pressures. A fluid impervious wall formed with inlet and outlet ports therethrough is partially covered by inner and outer closure members, both of which are supported and keyed by a common rod or shaft. These closure members are each biased by a common helical spring toward sealed and closed positions in which the inlet and outlet ports are covered. Pressure differentials are equalized by displacement of at least one of said closure members, thereby permitting air flow through one of the respective ports. By preselecting the spring rate of the helical spring, the minimum forces required to displace the closure members are controlled and predetermined.

10 Claims, 5 Drawing Figures

VENTILATOR

This invention relates generally to freezer air vents, and more particularly to an improved ventilator for use with coldroom enclosures or the like.

It is well known that the removal of airborne moisture by the freezing process within a freezing chamber results in the creation of a partial vacuum condition. This vacuum condition causes an imbalance or differential pressure between the environmental or atmospheric air outside of the enclosure or freezing chamber, and the fluid or air within the chamber itself.

It is also known that a relative increase in pressure within this same enclosure or freezing chamber results when the access door to the freezer is closed. This sudden increase in air pressure is noticed and sensed by the ears of personnel who may be working within the freezer.

A need exists for an efficient and reliable ventilator which is capable of equalizing these fluid or air pressure differentials. The required ventilator should accomplish these ends without permitting excessive amounts of air to enter or leave the freezer enclosure. To permit this would be to waste the energy and efforts, not to say the dollars, required to cool and maintain the air air at a predetermined temperature within the chamber itself.

It is my desire here to bring to the attention of the Examiner and the reader certain patented prior art attempts to accomplish results similar to those sought to be accomplished by the present invention. More specifically, U.S. Pat. No. 3,813,896 to Lebahn discloses an air vent for use with freezers of the industrial or walk-in type. A vacuum relief valve having a vacuum-responsive valve element opens in response to a partial vacuum in the freezing chamber and admits outside air to relieve this partial vacuum. A relatively complicated arrangement which employs, of all things, ping pong balls is disclosed by this patent. U.S. Pat. No. 3,785,401 to Button discloses an air breather assembly for mounting upon a container wall having an opening equipped with a loaded valve. This patent discloses yet a far more complicated attempt to provide an intake of atmospheric air in the event the internal pressure of the container should pass below atmospheric pressures.

U.S. Pat. No. 3,680,329 to Burtis discloses a pressure equalizing valve for use with refrigerated equipment. This patent is specifically directed to the air-tight condition established by the inability of air to enter or leave the refrigerated space. The Burtis patent discloses a fairly conventional type of pivotal valve member mounted for hinged movement between open and closed positions.

U.S. Pat. No. 3,538,943 to Losito discloses a door vent which is equipped with a valve plate for insertion into a circular door aperture. The Losito device utilizes a fairly well known double-flap type arrangement wherein separate doors or valve members are hinged for respective, inward and outward pivotal movement. U.S. Pat. No. 3,173,356 to Schierse et al, while certainly not pertinent to the issue of patentability of the present invention, does disclose a safety air valve for use with air raid shelters. The Schierse et al device is of interest only in that sudden changes of air pressure waves are compensated for through the use of a fairly complicated structural arrangement.

Other devices or attempts to deal with changes in pressures can be seen in U.S. Pat. Nos. 3,138,173; 3,111,301; 2,798,422; 2,588,289; 2,820,475; 2,580,851; 2,184,773; 2,103,935; 1,623,286; and 1,153,051. None of these patents discussed or listed above anticipates the invention to be described in more detail below.

It should also be emphasized here that, in addition to the needs described above for a ventilator of the type provided by this invention, other needs exist. In commercial freezers or coldrooms, it is important for personnal entering and leaving the enclosures to be able to gain access quickly and easily to either the enclosure proper or spaces outside of the coldroom. It should be obvious that, with partial vacuums or reduced pressures created within the freezer, it is relatively more difficult to open the door since this partial vacuum results in a retarding force equal to the difference in pressure multiplied by the projected surface area of the door itself. This problem would be overcome if the pressure differential were easily and rapidly equalized via the ingress or egress of fluid through a ventilator.

It is also desirable to control the minimum forces necessary to actuate the ventilator. This invention provides means by which these forces, induced by pressure differentials, may be preset and controlled, at the option of the user.

None of the conventional or prior art devices overcome problems associated with known efforts to accomplish these ends. Many of these devices freeze as a result of the accumulation of ice or frost thereon. Other known devices permit too great an amount of air to either enter or leave the freezer chamber, thereby running up the costs of operation of the freezer itself.

Accordingly, it is an object of the present invention to provide a ventilator which is relatively inexpensive to produce and which will provide the benefits that are needed in the industry.

Another object of this invention is to provide a ventilator, as above, wherein the minimum valve forces required to actuate the device itself may be predetermined or preselected, at the option of the user.

Yet another object of the present invention is to provide a ventilator which will equalize the internal and atmospheric pressures experienced by a coldroom, freezer, refrigerator, or the like.

A further object is to provide a ventilator in which the valving mechanism includes keyed closure members supported by a common, spring-biased and guided support means.

Yet another object is to provide a ventilator whose valving mechanism includes valve closure members which are independently displaceable from their respective seats, thereby providing the user with an efficient and reliable valving operation.

According to one aspect of the present invention, the novel means and steps which are employed to overcome the disadvantages of prior art solutions associated with the problems sought to be overcome by this invention include a ventilator for use in equalizing pressures within and without an enclosure, such as a coldroom or the like. A heated valve assembly is situated within an enclosure wall opening such that it is freely exposed to both environmental and internal fluid air pressures. A fluid impervious wall formed with inlet and outlet ports therethrough is partially covered by inner and outer closure members, both of which are supported and keyed by a common rod or shaft. These closure members are each biased by a common helical spring toward sealed or closed positions in which the inlet and outlet ports are covered. Pressure differentials are equalized by displacement of at least one of the closure members, thereby permitting airflow through one of the respective ports. By preselecting the spring rate of the helical spring, the minimum forces required to displace the closure members are controlled and predetermined.

My invention will be more clearly understood from the following description of a specific embodiment of the invention, together with the accompanying drawings, wherein similar reference characters denote similar elements throughout the several views, and in which.

Figure 1:
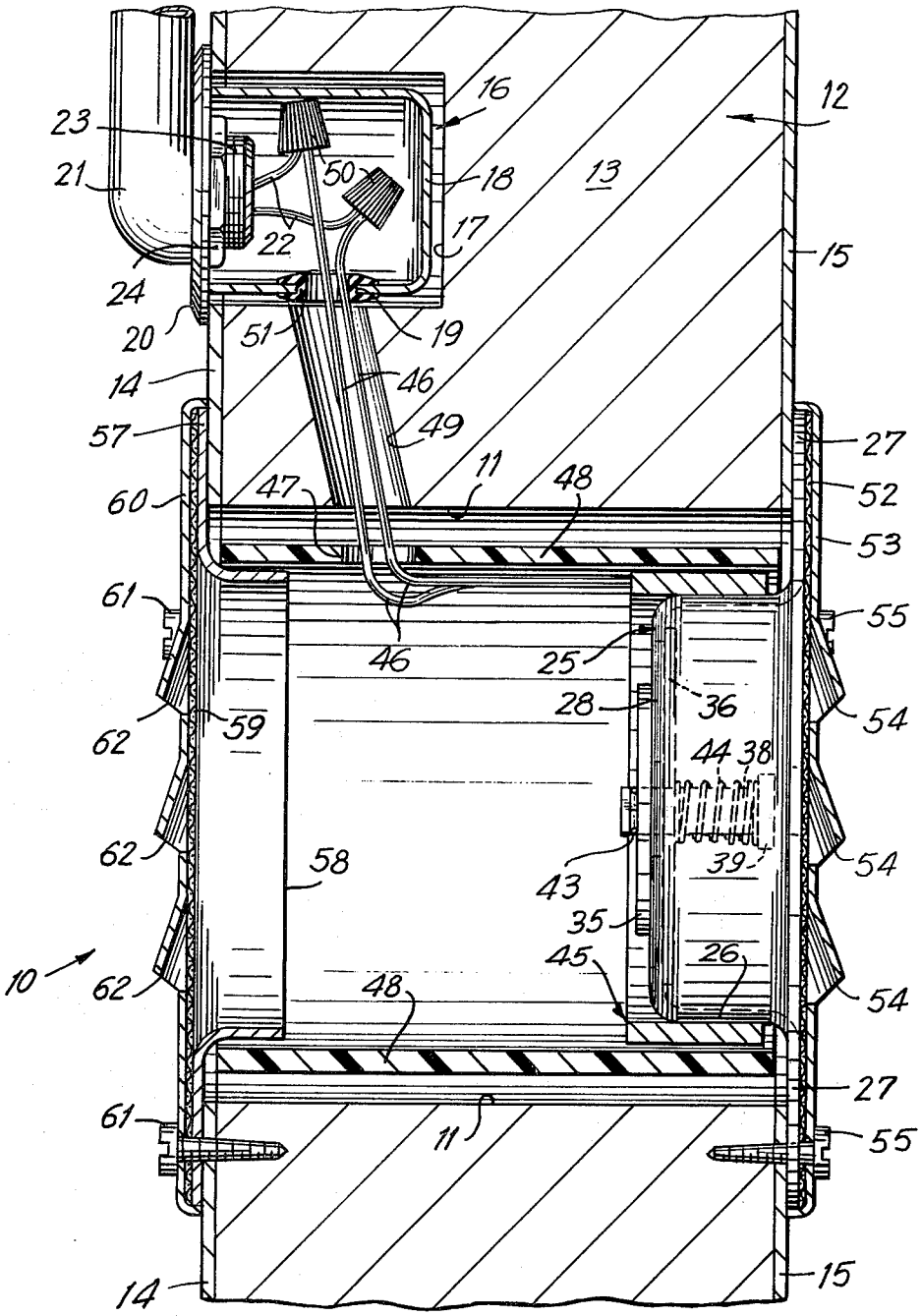
FIG. 1 is a fragmentary sectional elevational view of a ventilator according to the present invention.

Before looking at the specific elements which comprise the ventilator of the present invention, it should be mentioned here that the valve assembly, later designated by reference character 10, may be mounted within its associated supporting wall either in the position shown in FIG. 1, or in a reversed position whereby the elements are simply inserted from different sides. This may be accomplished without affecting the scope or intent of the present invention.

Referring now in more detail to the drawings, FIG. 1, in a fragmentary sectional elevational view, illustrates a ventilator assembly 10 mounted within an opening 11 in a supporting wall 12. Supporting wall 12 may be just that, namely, a wall of an enclosure or, for that matter, may be a door within which ventilator assembly 10 is situated. It is contemplated that the present invention be utilized with cold rooms or refrigerators, and supporting wall 12 comprises a portion of the enclosure being ventilated by the present invention. For purposes of illustration, supporting wall 12 will be described as either a supporting wall or a wall panel consisting of internal insulation 13 sandwiched between aluminum or metallic covering sheets 14 and 15.

FIG. 1 further illustrates a junction box assembly 16 situated within a cutout or opening 17 which may be an existing cutout or which may be created by the user of the present invention at the time ventilator assembly 10 is installed within supporting wall 12. Junction box assembly 16 consists of a metallic box 18 formed with an opening 19 of a sufficient size as to accommodate a plurality of electrical wires therethrough. A face plate 20 covers what would otherwise be an open box 18 and, in turn, supports an an electrical conduit 21 through which conductors 22 extend into box 18. Conduit 21 terminates in a threaded end 23 which is held securely to face plate 20 by means of a nut 24.

Assembly 10 includes a flanged body 25 formed with a drawn well portion 26 integral with flange 27. Flanged body 25 is preferably formed from aluminum and its well portion 26 includes a substantially planar wall 28. Wall 28 is formed with and defines spaced openings 29, 30, 31 and 32, each of which is formed in a similar shape best illustrated in FIGS. 2 and 3. A substantially central rectangular opening 33 is also formed through wall 28 such that its longitudinal axis bisects openings 31 and 32. Three mounting holes 34 extend through flange 27 in spaced relationship at approximately 120° from one another.

Figure 2:
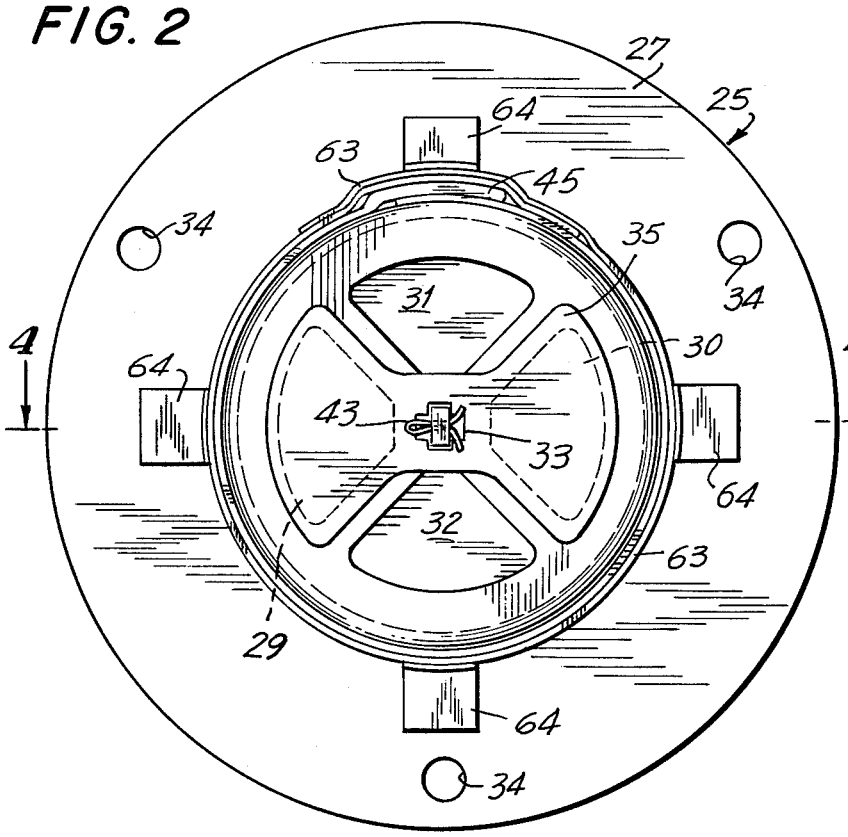
FIG. 2 is a front elevational view of one side of the ventilator assembly comprising this invention.
Figure 3:
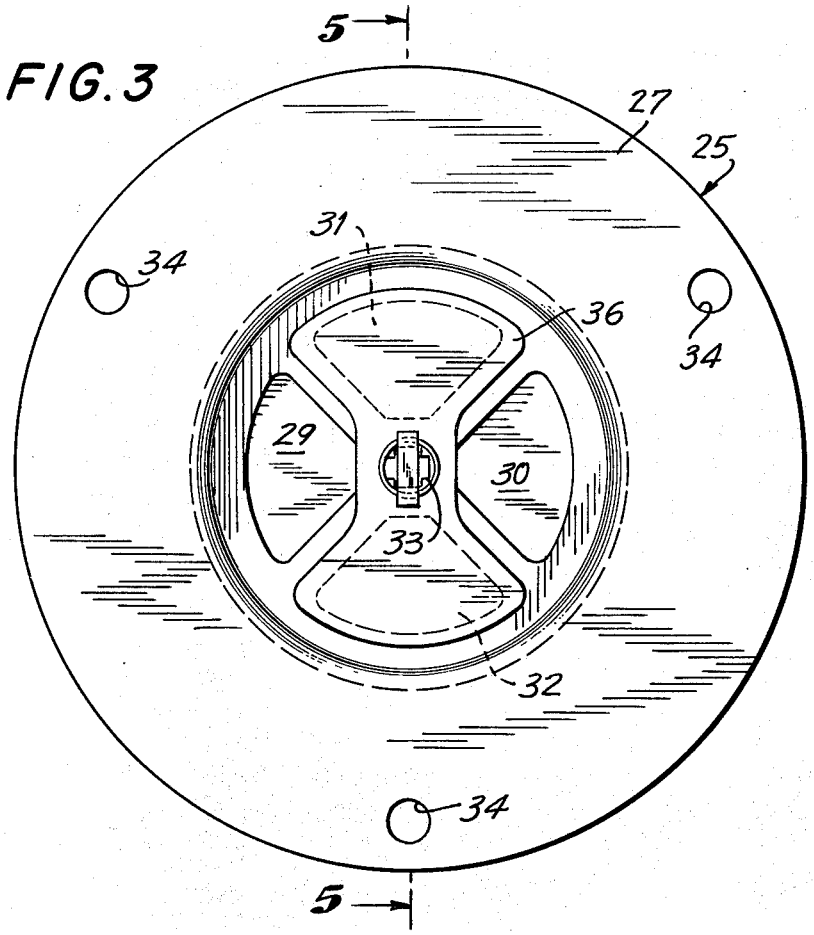
FIG. 3 is an elevational view of the ventilator illustrated in FIG. 2, looking at the side opposite that shown in FIG. 2.

Closure members 35 and 36 are located, respectively, on the outside and inside well portion 26 of flanged body 25. In a preferred embodiment of the present invention, closure members 35 and 36 are identical in shape or structural configuration, thereby rendering them interchangeable to the manufacturer of this invention. This invention contemplates a variety of shapes of openings 29, 30, 31 and 32 and, therefore, a variety of shapes of closure members 35 and 36. In each case, however, the shape or structural configuration of closure member 35, for example, is such that its projected area, best illustrated in FIG. 2, is such that it is capable of covering openings 29 and 30 when in abutting relationship or contact with wall 28. Similarly, the projected area of closure member 36 is such that this closure member is capable of covering openings 31 and 32 when the closure member is in contact with wall 28.

It should be emphasized here that the covering of openings 29, 30, 31 and 32 by closure members 35 and 36 refers to the operative closing or sealing of these openings. This closing and sealing of these openings need not be absolutely precise for the present invention to operate according to its intended purposes. Substantial closing or sealing is sufficient.

Figure 5:
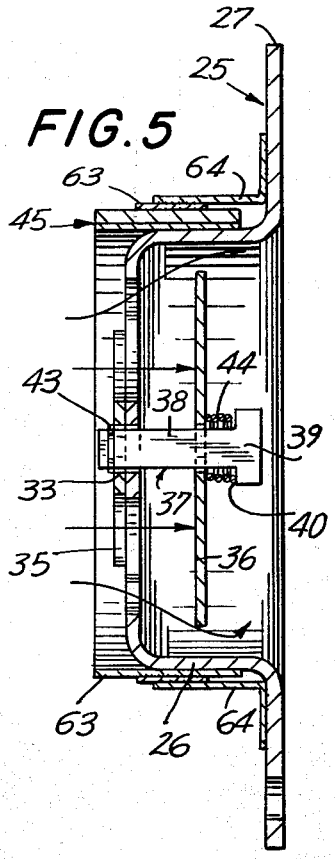
FIG. 5 is a sectional elevational view similar to that of FIG. 4, but illustrating an inner closure member displaced from its fluid impervious wall.

Closure members 35 and 36 are mounted upon or supported by an elongated shaft 37. Shaft 37 comprises an elongated member of rectangular cross section, preferably made of formed from aluminum. Shaft 37 includes a portion 38 of lesser width which terminates at its rightmost end as shown in FIG. 5 at an enlarged portion 39 of greater width. The step of portion 38 to portion 39 exposes a pair of bearing surfaces 40.

It should be noted here that each of closure members 35 and 36 is formed with a substantially central opening of preselected shape or configuration. In the case of closure member 35, a central opening 41 of cross-shaped configuration is formed therethrough. As used herein, the term "cross-shaped" refers to a pair of substantially rectangular slots of equal length, which intersect one another at right angles to form a cross of symmetrical shape. Similarly, closure member 36 is formed with a central opening 42 of a shape substantially identical to that of central opening 41.

Figure 4:
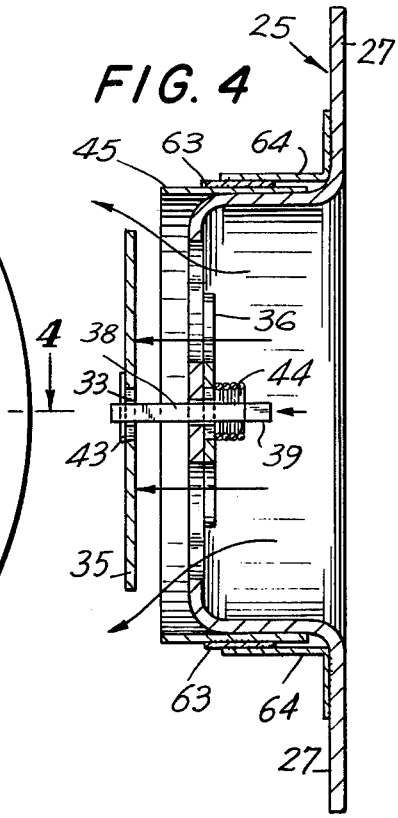
FIG. 4 is a sectional elevational view taken along the line 4—4 of FIG. 2, and illustrating an outer closure member displaced from its associated fluid impervious wall.

A keying of shaft 37 with respect to opening 33, as well as with respect to each of closure members 35 and 36, is facilitated by the fact that shaft 37 and, more particularly, its portion 38 is capable of extending through opening 33 and through each of the intersecting rectangular openings which comprise each of central openings 41 and 42. More simply stated, as shown in FIGS. 4 and 5, for example, portion 38 of shaft 37 extends, looking from right to left in FIG. 5, first through central opening 42 in closure member 36 — thereafter through opening 33 in wall 28 — and thereafter through central opening 41 in closure member 35. In the assembled configuration illustrated in FIGS. 2–5, inclusive, the longitudinal axes of closure members 35 and 36 extend perpendicularly with respect to one another. A cotter pin 43 extends through a relatively small opening proximate the extremity or end of portion 38. Cotter pin 43 serves to ensure that the shaft or rod and closure member combination remain secured to one another, as shown.

A helical spring 44 biases closure member 35 and closure member 36 toward wall 28. In their closed or sealed positions, best illustrated in FIG. 1, closure member 35 lies in contact against wall 28 such that it covers and seals openings 29 and 30. Similarly, in its closed or sealed position, closure member 36 lies in contact with wall 28 such that it covers and seals openings 31 and 32. Each of closure members 35 and 36 may be displaced from wall 28, thereby opening the openings 29 and 30; and 31 and 32, respectively. In normal operation whereby a pressure differential exists as between fluids on one side of wall 28 and on the other side thereof, forces resulting from this pressure differential which are greater than the biasing spring forces of helical spring 44 will cause a displacement of one or the other of closure members 35 or 36. As shown in FIG. 1, should the pressure of fluid or air be greater on the leftmost side of wall 28 than on the rightmost side thereof, and should the forces resulting from this pressure differential which act upon the surfaces of closure member 36 which overlie openings 31 and 32 be greater than the compressive forces within helical spring 44, in such cases closure member 36 will be displaced away from wall 28 and against the compressive forces of spring 44 to the position shown in FIG. 5.

On the other hand, should the pressures of fluids on the right hand side of wall 28 be greater than those on the left side thereof, closure member 35 will be displaced away from wall 28 to the position shown in FIG. 4. In FIGS. 4 and 5 the reader will see that fluid or air is permitted to pass through either of the combinations of openings 29 and 30, or 31 and 32, depending upon the direction of differential fluid forces. The arrows in FIGS. 4 and 5 illustrate both the direction of forces upon the respective closure members 35 and 36, and also illustrate the bypassing of fluid or air through openings covered by these closure members.

Thus, in circumstances where a freezer, for example, contains air at reduced temperatures, the differential pressures between the air within the freezer and outside of the freezer will be able to equalize themselves, without manual labor, utilizing the ventilator assembly comprising the present invention. Similarly, in cases where a relatively fluid-tight seal in maintained for an enclosure, the ventilator assembly 10 of this invention may be used to render the closing of access openings to the enclosure far easier, without adversely affecting the eardrums of personnel who may be working within the enclosure.

The reader's attention is now directed to other features of the present invention which have not been described and which provide yet further advantages to the user. FIGS. 1 and 2 best illustrate a heating assembly 45 which annularly envelopes well portion 26 of flanged body 25. Heating assembly 45 is preferably of a 115–220 V, 12 watt, 60 cycles per second type unit, of the type conventionally available under the trademark "Electro-Flex". No claim is made by me to the iternal workings of heating assembly 45, per se.

Lead wires 46 extend from heating assembly 45 through an opening 47 formed in an insulating sleeve 48 and thereafter through a hole 49 formed in insulation 13 of supporting wall 12. Lead wires 46 thereafter enter junction box assembly 16 through opening 19 where they are joined in an electrical connection to conductors 22. Electrical caps 50 protect the interconnections of lead wires 46 to conductors 22. In a preferred embodiment of this invention, a protective grommet made from a material such as rubber is provided about the opening 19 in box 18 — illustrated in FIG. 1 and designated numeral 51.

Heating assembly 45 maintains the temperature of ventilator assembly 10 within a preselected range, such that its operation is not affected by lower temperatures and possible buildups of frost and ice. The presence of insulating sleeve 48, which is preferably a portion of plastic piping, serves to aid in this temperature control. Electricity supplied through conductor 22 is carried by lead wires 46 to heating assembly 45, thereby providing the energy for the latter's operation.

Flanged body 25 covers the inner entrance to opening 11, and it, itself, is covered with a screen preferably comprising an aluminum wire mesh and designated reference numeral 52 in FIG. 1. Screen 52, in turn, is covered by a louvered aluminum cover 53 having louvered slots 54 through which fluid or air is free to pass. The sandwiched assembly of louvered cover 53, screen 52 and flanged body 25 is firmly secured to supporting wall 12 means of sheet metal screws 55. Openings 34 within flange 27 provide clearance for these sheet metal screws 55.

At the outer entrance to opening 11 of supporting wall 12, a second flanged body 56 is provided which differs from flanged body 25. While a flange portion 57 is provided corresponding to flange 27 of flanged body 25, flanged body 56 does not have a counterpart to well portion 26, but rather is provided with an unobstructed open end 58 of a diameter slightly less than the inner diameter of insulating sleeve 48. In much the same manner as for flanged body 25, flanged body 56 is provided with a covering screen 59 and louvered cover 60, each of which may be virtually identical to the aforementioned screen 52 and louvered cover 53. As in the case of the inner side, sheet metal screws 61 corresponding to sheet metal screws 55 firmly secure the sandwiched assembly of louvered cover 60, screen 59 and flanged body 56 to supporting wall 12. Again, as in the case of louvered cover 53, louvered cover 60 is provided with louvered slots 62 through which air or fluid may pass in an unobstructed manner.

The presence of screens 52 and 59 provide means of filtering impurities from the internal portions of ventilator assembly 10; however, they are not absolutely necessary to the normal operation of this ventilator. Similarly, while not necessary, FIGS. 2, 4 and 5 illustrate means by which heating assembly 45 is secured to flanged body 25. Preferably, a continuous annular strip of pressure sensitive or adhesive tape 63 is wrapped about the strip-type element comprising heating assembly 45 to hold same in overlapping relationship with itself, best illustrated in FIG. 2. A plurality of relatively shorter strips 64 of this same type of tape are thereafter added to secure the wrapped heating assembly to flange 27 of flanged body 25. Of course, alternate methods of securing heating assembly 45 to flanged body 25 will serve equally well and come within the scope of the present invention.

It should be appreciated that the user of the ventilator comprising this invention may, at his option, preselect and, for that matter, change the helical spring 44 such that a desired spring rate is experienced insofar as the aforementioned biasing faces are concerned. Thus, the greater the spring rate, the greater the pressure differential required to open the respective port.

Another imporant feature of my invention resides in the keying of closure members 35 and 36, both with respect to one another, as well as with respect to the orientation of openings 29, 30, 31 and 32. Closure members 35 and 36 are unable to rotate upon rod or shaft 37 more than a preselected amount, as a result of the configurations of the opening in these closure members and wall 28, and the cross-sectional shape of rod or shaft 37.

The embodiment of the present invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. A ventilator for use in controlling the flow of fluid such as air to and from an enclosure or the like, the enclosure including a supporting wall defining a ventilating opening therethrough, the improvement comprising: a valve assembly having portions thereof disposed within said ventilating opening, said valve assembly including a substantially fluid impervious wall formed with a guide opening therethrough and further defining first and second fluid ports therethrough, a first closure member springbiased toward a normally closed position such that portions thereof substantially cover said first fluid port, a second closure member spring-biased toward a normally closed position such that portions thereof substantially cover said second fluid port, spring means for causing said biasing of said first and second closure members, and guide means carrying said spring means for both guiding each of said closure members between said closed positions and open positions, respectively, and for maintaining a substantially predetermined alignment between said closure members with respect to one another as well as with respect to the disposition of said ports, said valve assembly permitting substantial equalization of fluid pressure differentials at said ventilating opening.

2. A ventilator according to claim 1, wherein said guide means comprises an elongated shaft of a predetermined cross section cooperatively keyed to said guide opening.

3. A ventilator according to claim 2, wherein said shaft includes a portion rectangular in cross section which extends through said guide opening, said keyed relationship preventing rotation of said shaft.

4. A ventilator, according to claim 3, wherein said shaft includes bearing surfaces from said rectangular portions, said spring means comprising a helical spring disposed about portions of said shaft intermediate said bearing surfaces and said rectangular portions.

5. A ventilator according to claim 1, wherein said fluid impervious wall defines at least one first fluid port disposed upon a first axis and having a first shape, and at least one second fluid port disposed upon a second axis which extends at an angle with respect to said first axis, said first and second closure member portions covering said first and second fluid ports, respectively, being disposed in unobstructing positions with respect to said second and first fluid ports, respectively, whereby fluid flow through either of said ports is facilitated notwithstanding a closing of the other thereof.

6. A ventilator, according to claim 5, wherein said angle is substantially ninety degrees.

7. A ventilator according to claim 6, wherein said fluid impervious wall defines two first and two second fluid ports.

8. A ventilator according to claim 1, further comprising heating means for maintaining said valve assembly within a predetermined temperature range.

9. A ventilator according to claim 8, wherein said heating means comprises an electrical heating element disposed about portions of the valve assembly.

10. A ventilator, according to claim 1, wherein said first and second closure members may be simultaneously displaced from their respective normally closed positions.

* * * * *